US008418753B2

(12) United States Patent
Hirokawa et al.

(10) Patent No.: US 8,418,753 B2
(45) Date of Patent: Apr. 16, 2013

(54) HEAT EXCHANGE TUBE

(75) Inventors: Isao Hirokawa, Hamamatsu (JP); Tetsuaki Nakayama, Hamamatsu (JP); Yasuyuki Watanabe, Hamamatsu (JP); Toshihiro Kondo, Hamamatsu (JP); Atsumu Naoi, Wako (JP); Hideyuki Ushiyama, Wako (JP)

(73) Assignees: Yutaka Giken Co., Ltd., Hamamatsu-shi (JP); Honda Motor Co., Ltd., Tokyo (JP)

( * ) Notice: Subject to any disclaimer, the term of this patent is extended or adjusted under 35 U.S.C. 154(b) by 498 days.

(21) Appl. No.: 12/698,553

(22) Filed: Feb. 2, 2010

(65) Prior Publication Data

US 2010/0224349 A1 Sep. 9, 2010

(30) Foreign Application Priority Data

Mar. 5, 2009 (JP) ..... 2009-51602

(51) Int. Cl.

| | |
|---|---|
| ***F28D 7/02*** | (2006.01) |
| ***F28F 1/10*** | (2006.01) |
| ***F28F 1/00*** | (2006.01) |
| ***F28F 1/42*** | (2006.01) |

(52) U.S. Cl.

USPC ..... 165/177; 165/179; 165/164; 165/172

(58) Field of Classification Search ..... 165/164, 165/172, 179, 155, 154, 901; 122/15.1, 424, 122/426; 60/299, 320, 298

See application file for complete search history.

(56) References Cited

U.S. PATENT DOCUMENTS

| | | | | |
|---|---|---|---|---|
| 2,197,243 | A * | 4/1940 | Moran | 138/38 |
| 3,170,511 | A * | 2/1965 | Guthrie | 165/108 |
| 3,601,982 | A * | 8/1971 | McCrocklin | 60/303 |
| 4,314,587 | A * | 2/1982 | Hackett | 138/38 |
| 5,577,555 | A | 11/1996 | Hisajima et al. | |
| 5,655,599 | A * | 8/1997 | Kasprzyk | 165/133 |
| 5,915,467 | A * | 6/1999 | Ishikawa et al. | 165/133 |
| 5,937,801 | A * | 8/1999 | Davis | 123/41.33 |

(Continued)

FOREIGN PATENT DOCUMENTS

| | | | |
|---|---|---|---|
| GB | 2249163 | A | 4/1992 |
| JP | 9-113165 | A | 5/1997 |

(Continued)

OTHER PUBLICATIONS

European Search Report dated Jun. 15, 2010, issued in corresponding European Patent Application No. 10152493.

(Continued)

*Primary Examiner* — Ljiljana Ciric
*Assistant Examiner* — Jason Thompson
(74) *Attorney, Agent, or Firm* — Westerman, Hattori, Daniels & Adrian, LLP

(57) ABSTRACT

A heat exchange tube is constructed by forming, on a cylindrical tube peripheral wall, a plurality of projecting portions which project to an inside of the tube peripheral wall, and which are formed by pushing. The plurality of projecting portions are formed, respectively, into conical shapes across a tube axis, and are arranged along virtual spirals on the tube peripheral wall. Accordingly, it is possible to provide a heat exchange tube which facilitates formation of a plurality of projecting portions with the thickness hardly changed and without formation of protruded portions, and which is capable of contributing to enhancement of heat exchanging efficiency.

1 Claim, 9 Drawing Sheets

U.S. PATENT DOCUMENTS

| | | | | |
|---|---|---|---|---|
| 6,823,668 | B2 * | 11/2004 | Endoh et al. | 60/320 |
| 6,945,197 | B2 * | 9/2005 | Ryoo | 122/15.1 |
| 6,945,320 | B2 * | 9/2005 | Harvard et al. | 165/109.1 |
| 7,011,150 | B2 * | 3/2006 | Komatsubara et al. | 165/177 |
| 7,213,639 | B2 * | 5/2007 | Danielsson et al. | 165/159 |
| 7,264,394 | B1 * | 9/2007 | Liles | 366/339 |
| 7,984,752 | B2 * | 7/2011 | Yusa | 165/154 |
| 8,231,837 | B2 | 7/2012 | Hashimoto | |
| 2005/0161209 | A1 | 7/2005 | Havard, Jr. et al. | |
| 2007/0089873 | A1 | 4/2007 | Beste et al. | |
| 2008/0029243 | A1 * | 2/2008 | O'Donnell et al. | 165/48.1 |

FOREIGN PATENT DOCUMENTS

| | | | |
|---|---|---|---|
| JP | 2004-85142 | A | 3/2004 |
| JP | 2008-249249 | A | 10/2008 |
| WO | WO 2006/136437 | * | 12/2006 |

OTHER PUBLICATIONS

Japanese Office Action dated Nov. 28, 2012, issued in corresponding Japanese Patent Application No. 2009-051602, (2 pages).

* cited by examiner

HEAT EXCHANGE TUBE

TECHNICAL FIELD

The application discloses an improvement of a heat exchange tube constructed by forming, on a cylindrical tube peripheral wall, a plurality of projecting portions which project to an inside of the cylindrical tube peripheral wall, and which are formed by pushing.

BACKGROUND OF THE INVENTION

A heat exchange tube is already known, as disclosed in, for example, Japanese Patent Application Laid-open No. 2004-85142. The heat exchange tube disclosed in Japanese Patent Application Laid-open No. 2004-85142 will be described based on FIGS. 7 to 9.

There is a conventional heat exchange tube 014 in which a plurality of projecting portions 031 are arranged in a zigzag form along an axis of the tube as shown in FIG. 7. In this case, there are the projecting portions 031 as shown in FIG. 8 and FIG. 9. In FIG. 8, the projecting portion 031 is formed so that its ridge becomes linear, and a peripheral wall 030 of the portion other than the projecting portion 031 is not deformed. In FIG. 9, the projecting portion 031 is also formed so that the ridge becomes linear, but the peripheral wall of the portion other than the projecting portion 031 is deformed so that opposite end portions in the peripheral direction of the projecting portion 031 are protruded.

Incidentally, the projecting portion shown in FIG. 8 is unfavorable in workability since the thickness of the ridge portion of the projecting portion 031 inevitably increases more than the thickness of it before formation of the projecting portion, and due to the linear ridge of the projecting portion 031, the peripheral length of the tube in the projecting portion 031 decreases more than that before formation of the projecting portion, and sufficient increase in the surface areas of the inside and outside of the tube cannot be desired due to the projecting portion. Further, in the projecting portion shown in FIG. 9, increase in the plate thickness of the ridge portion of the projecting portion 031 can be suppressed, but protruded portions 031*a* are formed at opposite ends in the peripheral direction of the projecting portion 031. Therefore, when the tube is inserted into the hole of another member, the protruded portions 031*a* inhibit or interfere with insertion of the tube, and have an adverse effect on the assembly property.

Further, as shown in FIG. 7, the height of each of the projecting portions 031 is set to be lower than the radius of the tube 014, and therefore, a linear main flow path F with which a plurality of projecting portions 031 do not interfere is formed inside the tube 014, which makes agitation of a fluid inside the tube 014 difficult, and inhibits enhancement of efficiency of heat exchange.

SUMMARY OF THE INVENTION

A heat exchange tube facilitates formation of a plurality of projecting portions with the thickness hardly changed and without formation of protruded portions, and further is capable of contributing to enhancement of heat exchanging efficiency.

According to a first feature, there is provided a heat exchange tube constructed by forming, on a cylindrical tube peripheral wall, a plurality of projecting portions which project to an inside of the cylindrical tube peripheral wall, and which are formed by pushing, wherein the plurality of projecting portions are formed, respectively, into conical shapes across a tube axis, and are arranged along virtual spirals on the tube peripheral wall.

On the tube peripheral wall, a plurality of projecting portions which project to the inner surface side of the tube peripheral wall, and are formed by pushing, are formed into conical shapes across the tube axis, and therefore, the thickness of each of the projecting portions hardly differs from the thickness of the original peripheral wall. Accordingly, forming by pushing of each of the projecting portions can be easily performed, and workability is favorable. In addition, the surface areas of the inside and outside of the tube can be effectively increased by the conical projecting portions.

Further, a plurality of projecting portions are arranged along the virtual spirals on the tube peripheral wall, whereby the spiral flow path is formed in the tube. In addition, the sectional area of the flow path changes to become the minimum at the position of the vertex of each of the projecting portions, and become the maximum at the intermediate position between the adjacent projecting portions, and the gas which flows in the above described spiral flow path is effectively agitated by repeating expansion and contraction while turning, whereby heat exchange can be efficiently performed between the fluids inside and outside the tube.

Furthermore, by the inward conical projecting portions, outward projections are not formed on the tube peripheral wall, and therefore, interference with the other members of the tube is avoided, which can contribute to improvement in assembly property of the heat exchanger.

According to a second feature, in addition to the first feature, the tube peripheral wall is divided into a plurality of axial areas and the plurality of projecting portions are arranged along the virtual spirals which are drawn in respective adjacent axial areas and have their turning directions inversed from each other.

According to the second feature, when the fluid flowing in the flow path in the tube while turning moves from one axial area to the other axial area, the fluid inverses the turning direction. Therefore, agitation of the fluid can be performed more effectively, and the aforementioned heat exchange can be performed more efficiently.

According to a third feature, in addition to the second feature, a distance along a direction of the tube axis between centers of the adjacent projecting portions in each of the regions is set to be smaller than a major diameter of each of the projecting portions.

According to the third feature, the spiral flow path in the tube can be reliably formed in each of the axial areas, and the agitation effect of the fluid can be enhanced.

The above description, other objects, characteristics and advantages will be clear from detailed descriptions which will be provided for the preferred embodiment referring to the attached drawings.

BRIEF DESCRIPTION OF THE DRAWINGS

The advantages of the invention will become apparent in the following description taken in conjunction with the drawings, wherein.

DETAILED DESCRIPTION OF THE INVENTION

An embodiment will be described below on the basis of the attached drawings.

Figure 1:
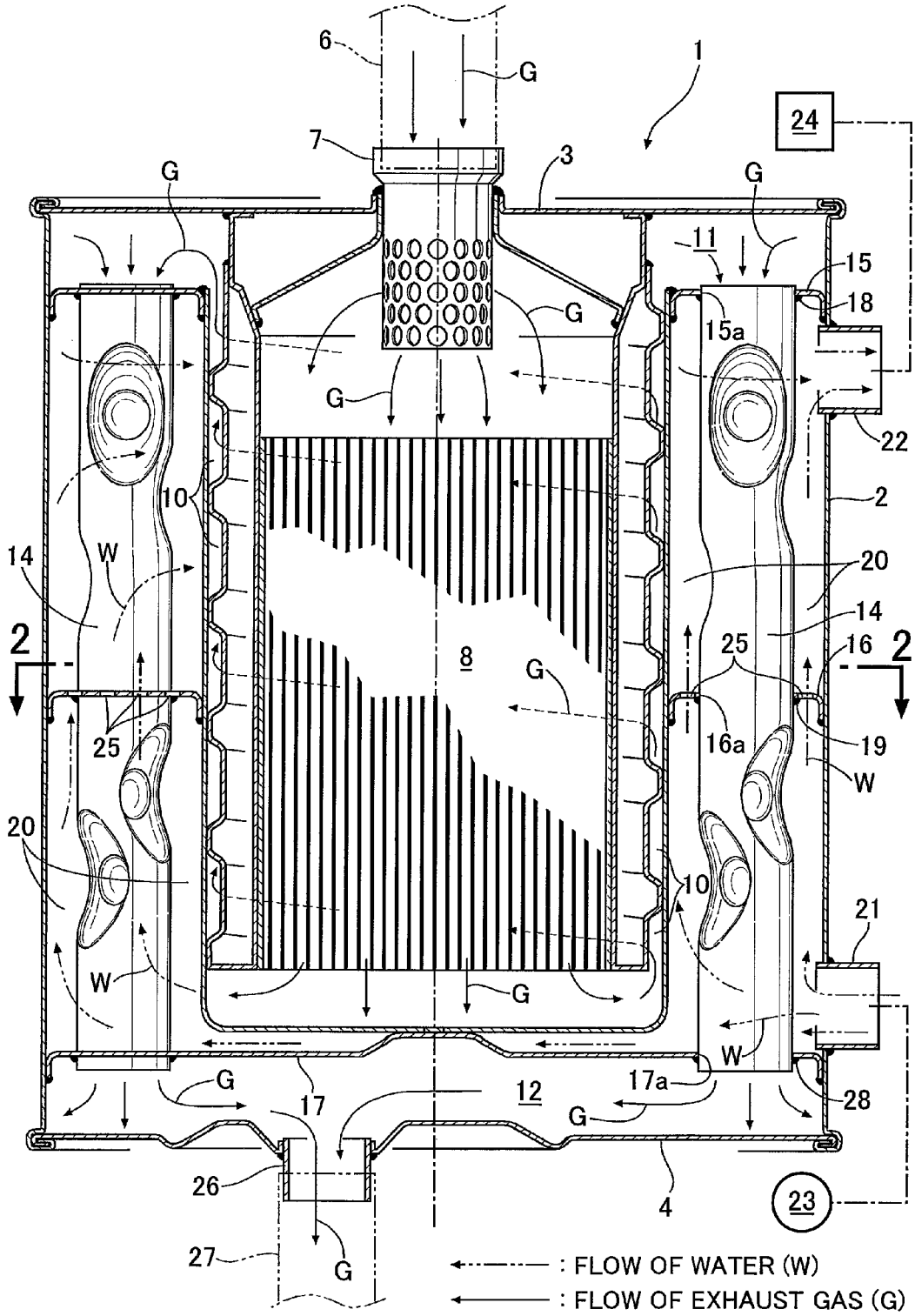
FIG. 1 is a longitudinal cross-sectional view of a heat exchanger for a gas cogenerator according to an embodiment of the present invention.
Figure 2:
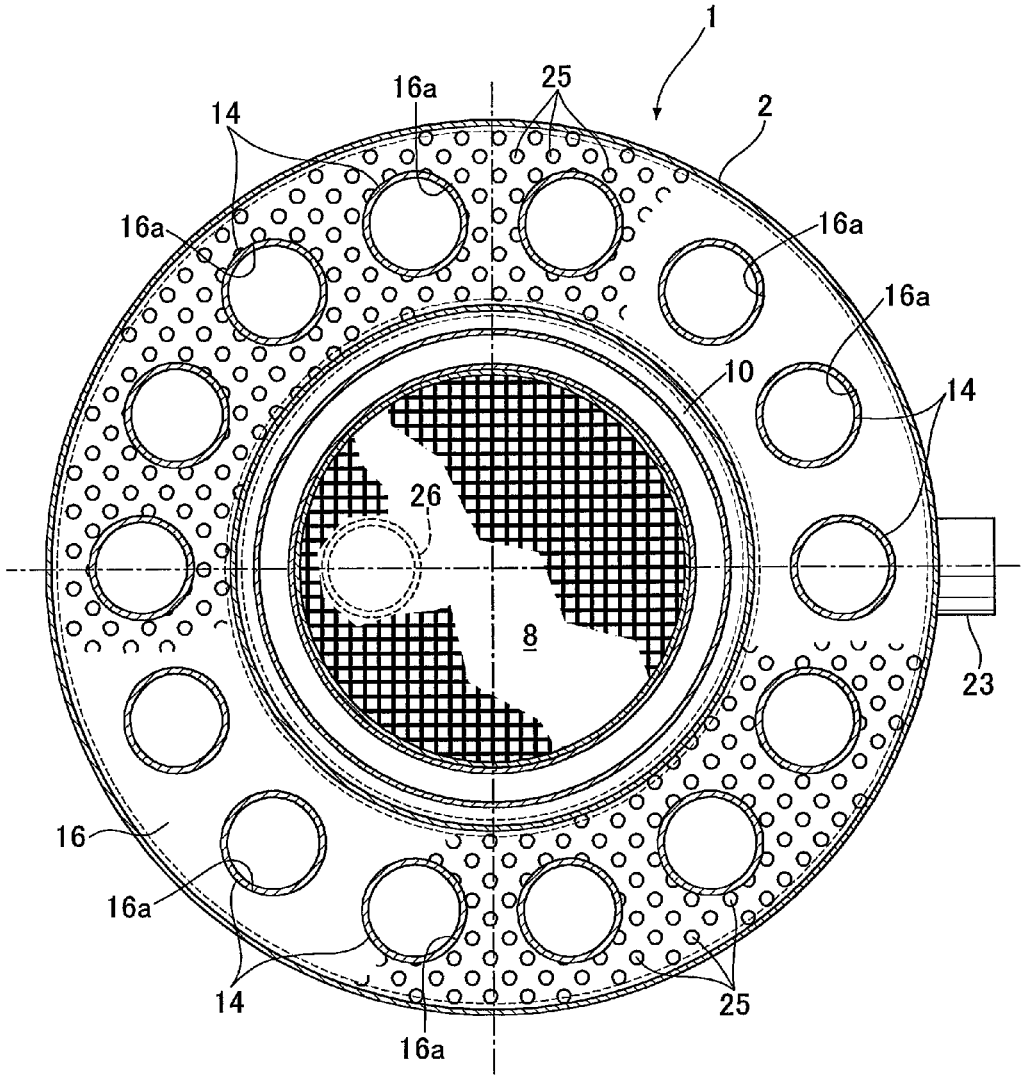
FIG. 2 is a cross-sectional view taken along line 2-2 in FIG. 1.
Figure 3:
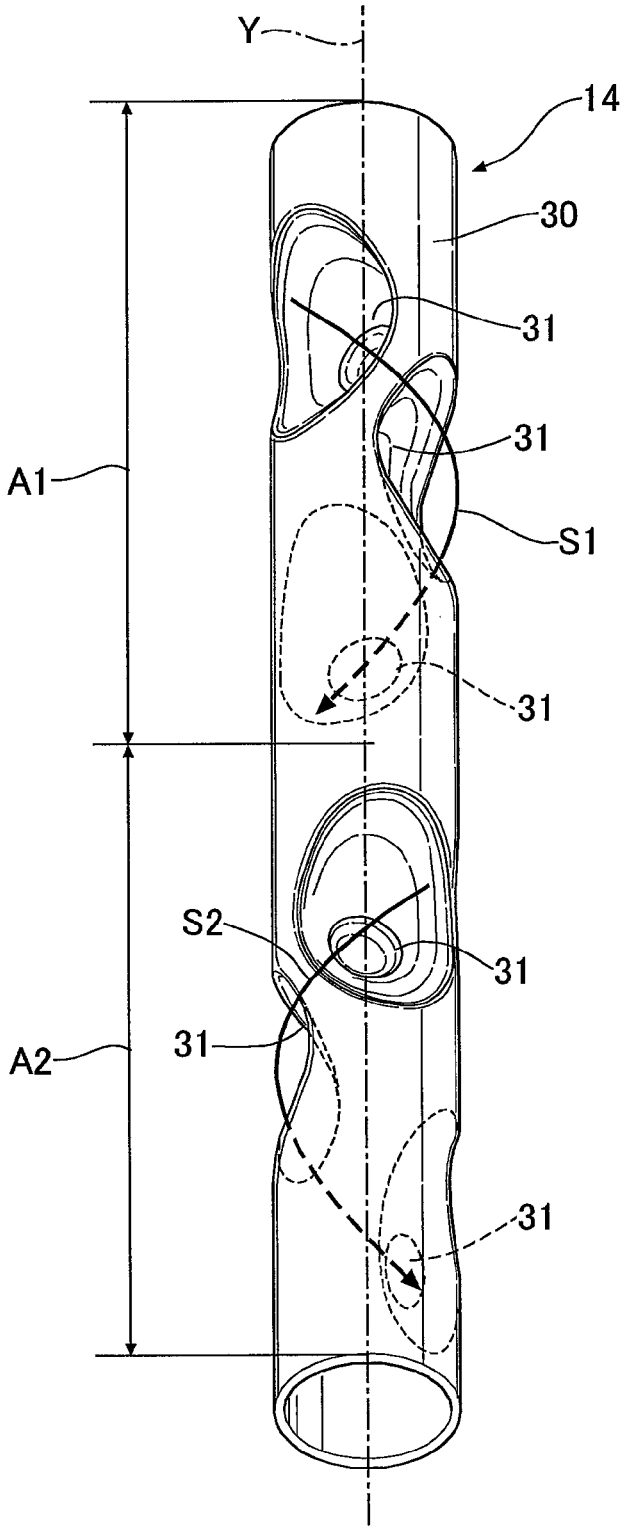
FIG. 3 is a perspective view of a heat exchange tube in the heat exchanger.
Figure 4:
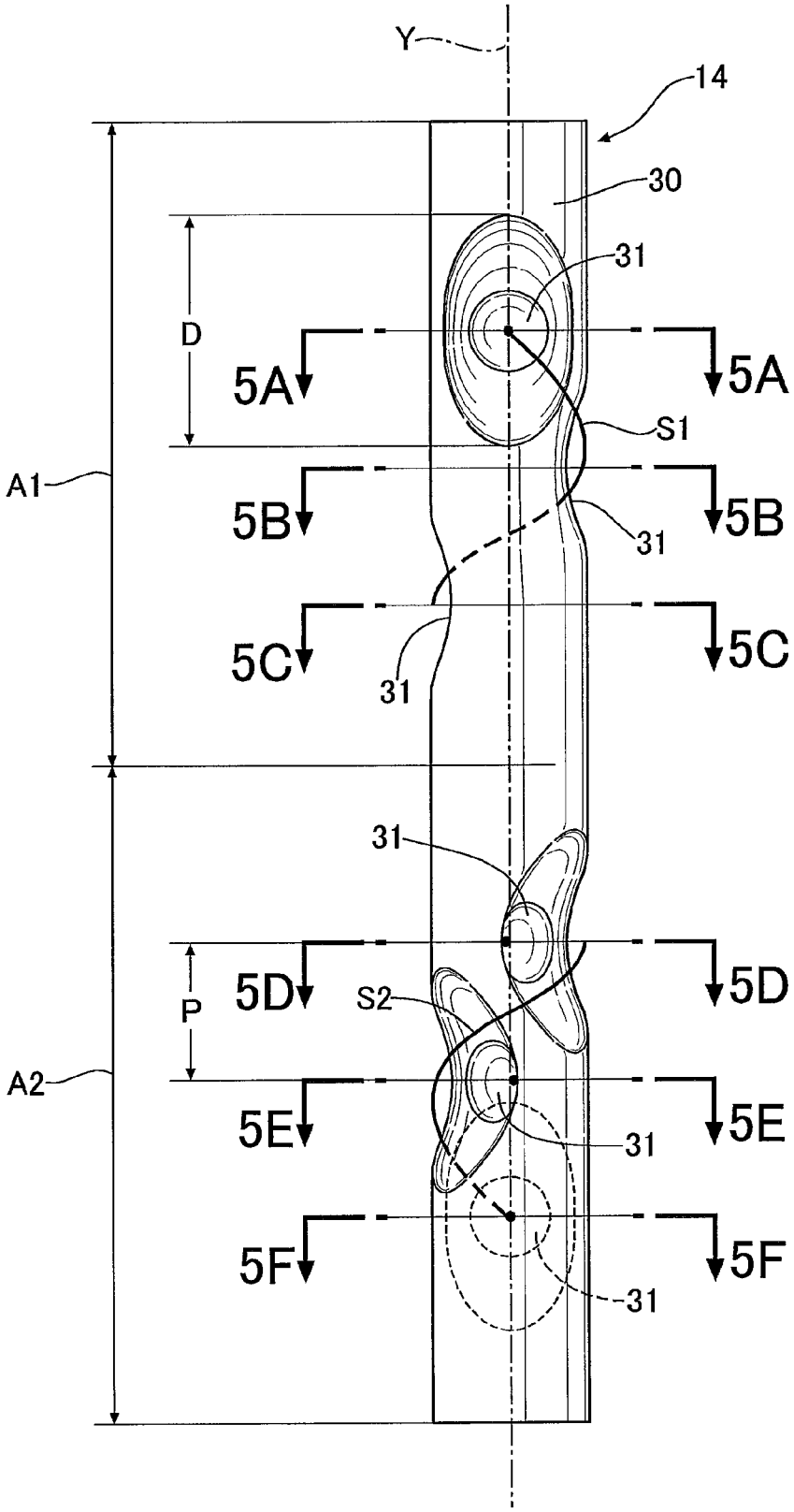
FIG. 4 is a side view of the heat exchange tube.
Figure 5A:
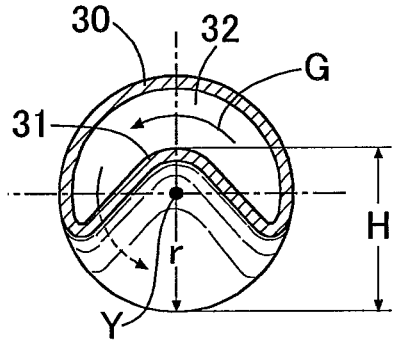
FIG. 5A is a cross-sectional view taken along line 5A-5A in FIG. 4.
Figure 5B:
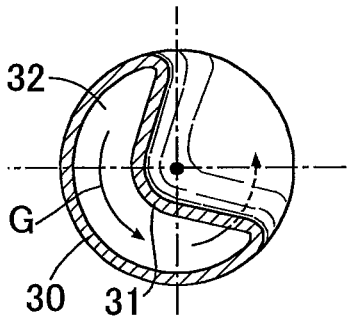
FIG. 5B is a cross-sectional view taken along line 5B-5B in FIG. 4.
Figure 5C:
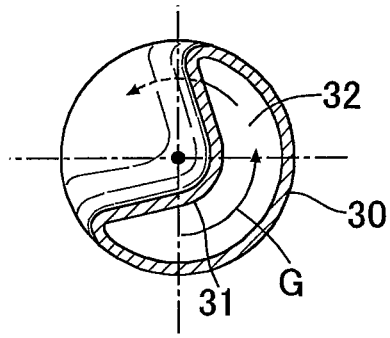
FIG. 5C is a cross-sectional view taken along line 5C-5C in FIG. 4.
Figure 5D:
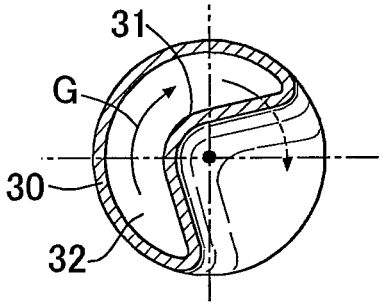
FIG. 5D is a cross-sectional view taken along line 5D-5D in FIG. 4.
Figure 5E:
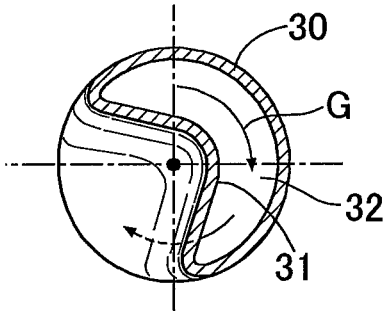
FIG. 5E is a cross-sectional view taken along line 5E-5E in FIG. 4.
Figure 5F:
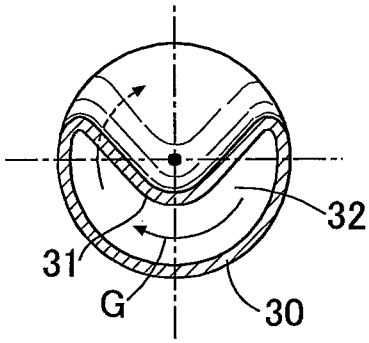
FIG. 5F is a cross-sectional view taken along line 5F-5F in FIG. 4.

First, based on FIGS. 1 and 2, a heat exchanger 1 for gas cogenerator using the heat exchange tube 14 of the present invention will be described.

The heat exchanger 1 for cogenerator has an outer barrel 2, and upper and lower end plates 3 and 4 which are connected to opposite upper and lower ends of the outer barrel 2. An exhaust gas inlet pipe 7, to which an exhaust pipe 6 of a gas engine is connected, is connected to a center portion of the upper end plate 3. A catalyst converter 8 for purifying exhaust gas, which communicates with the exhaust gas inlet pipe 7 is placed at the center portion of the outer barrel 2.

A spiral exhaust gas flow path 10 which communicates with a lower end of the catalyst converter 8 is formed around the catalyst converter 8. The exhaust gas flow path 10 communicates with an annular upper exhaust gas chamber 11 which is formed at an upper portion of the inside of the outer barrel 2. The upper exhaust gas chamber 11 communicates with a lower exhaust gas chamber 12 which is formed at a lower portion of the inside of the outer barrel 2 through a plurality of heat exchange tubes (hereinafter, simply called tubes) 14 according to the present invention.

These tubes 14 are arranged in the annular form to surround the spiral exhaust gas flow path 10, and are supported by an upper support plate 15, an intermediate support plate 16 and a lower support plate 17 which are connected to the outer barrel 2.

The upper support plate 15 has a plurality of support holes 15*a* in which the upper end portions of the tubes 14 are fitted, and defines a bottom wall of the upper exhaust gas chamber 11. The upper end portions of the tubes 14 are welded 18 to peripheral edge portions of the support holes 15*a* to be liquid-tight. The intermediate support plate 16 has a plurality of support holes 16*a* in which the intermediate portions of the tubes 14 are fitted, and the intermediate portions of the tubes 14 are welded 19 to peripheral edge portions of the support holes 16*a*. The lower support plate 17 has a plurality of support holes 17*a* in which the lower end portions of the tubes 14 are fitted, and the lower end portions of the tubes 14 are welded 28 to peripheral edge portions of the support holes 17*a*.

A heat receiving chamber 20 which houses a plurality of tubes 14 by being sandwiched by the outer barrel 2 and the spiral exhaust gas flow path 10 is defined between the upper exhaust gas chamber 11 and the lower exhaust gas chamber 12. A water inlet pipe 21 and a water outlet pipe 22 which open respectively to a lower portion and an upper portion of the heat receiving chamber 20 are provided at the outer barrel 2. A water supply source 23 such as a water line is connected to the water inlet pipe 21, and a hot water supply part 24 such as a hot water storage tank and a heater is connected to the water outlet pipe 22. A number of through-holes 25 which allow water to flow in the heat receiving chamber 20 are provided in the aforementioned intermediate support plate 16. An exhaust gas outlet pipe 26 which opens to the lower exhaust gas chamber 12 is provided in the lower end plate 4, and an exhaust pipe 27 which is opened to the atmosphere is connected to the exhaust gas outlet pipe 26.

Thus, when an exhaust gas G of the gas engine enters the exhaust gas inlet pipe 7, HC, $CO_2$ and the like are removed from the exhaust gas G while the exhaust gas G passes through the catalyst converter 8. Subsequently, the exhaust gas G rises in the spiral exhaust gas flow path 10 to move to the upper exhaust gas chamber 11 and lowers while splitting into a plurality of tubes 14. The split exhaust gas merges in the lower exhaust gas chamber 12, after which, the exhaust gas is released to the atmosphere through the exhaust gas outlet pipe 26 and the exhaust pipe 27.

During this time, water W which is supplied to the heat receiving chamber 20 from the water inlet pipe 21 receives heat from the exhaust gas G through the exhaust gas flow path 10 and the tubes 14, and becomes hot water to be supplied to the hot water supply part 24 from the water outlet pipe 22. Thus, the exhaust heat of the gas engine is effectively used for hot water supply, and the exhaust gas G can be discharged into the atmosphere by being reduced in temperature.

The aforementioned tube 14 will be described with reference to FIGS. 3 to 6.

As shown in FIGS. 3 to 5A to 5F, the tube 14 is made of a stainless steel pipe as a raw material, and in a cylindrical tube peripheral wall 30, a plurality of projecting portions 31, 31 which are projected to the inside of it and formed by pushing are formed as follows, and arranged.

Figure 6:
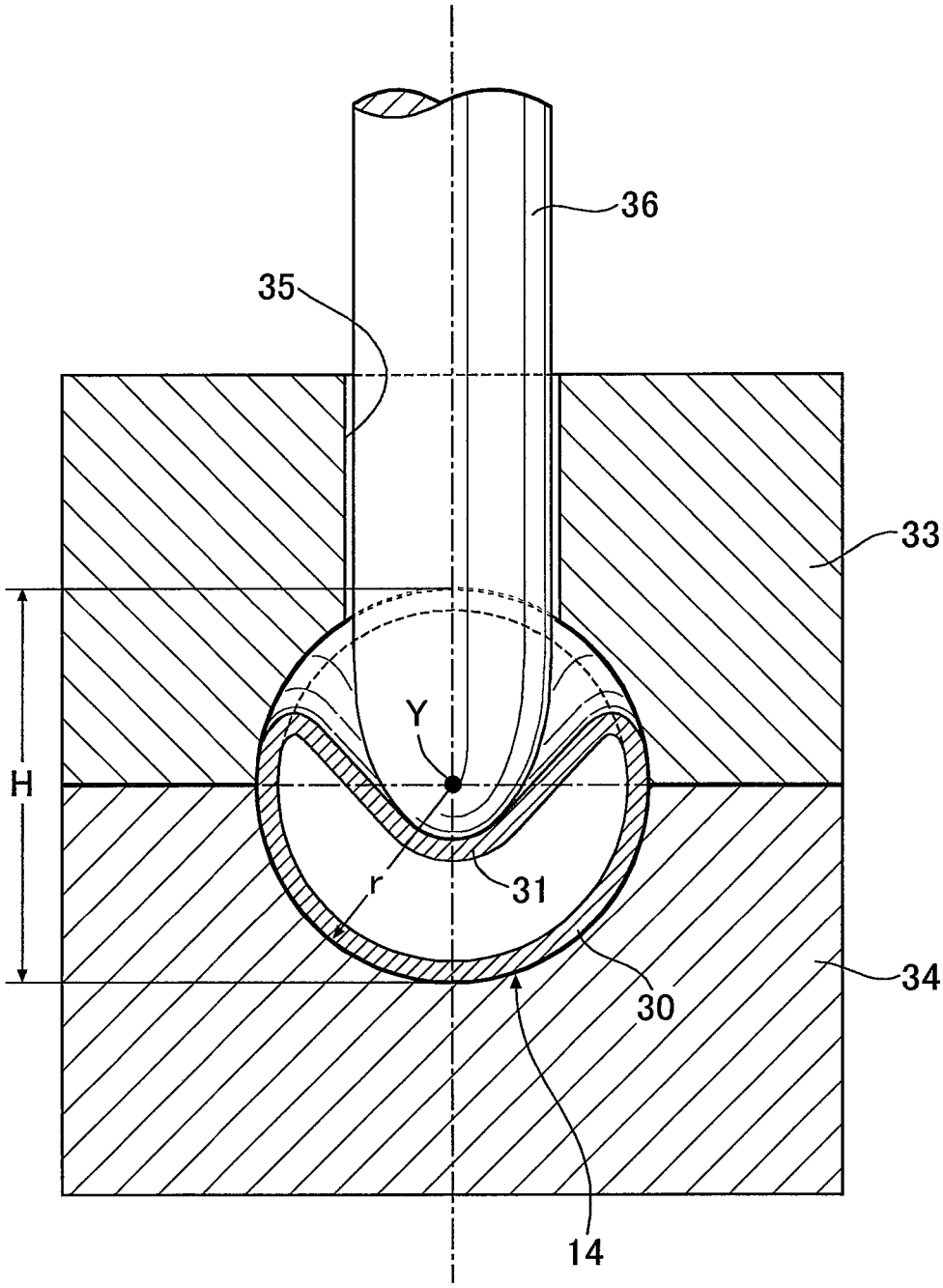
FIG. 6 is a view explaining a method to form by pushing a projecting portion in the heat exchange tube.
Figure 7:
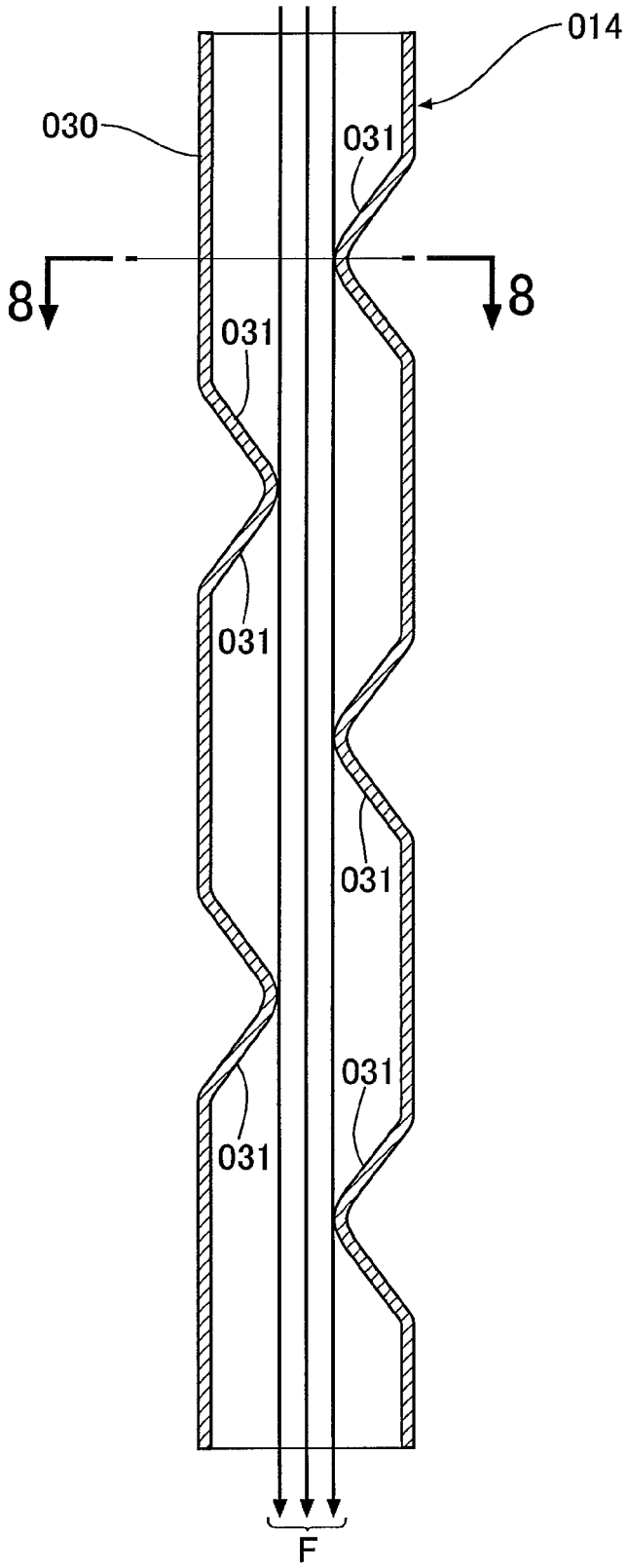
FIG. 7 is a longitudinal cross-sectional view of a conventional heat exchange tube.
Figure 8:
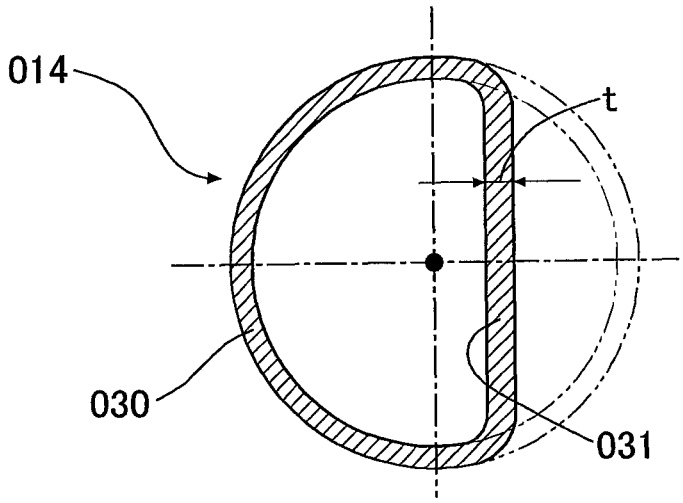
FIG. 8 is a cross-sectional view taken along line 8-8 in FIG. 7.
Figure 9:
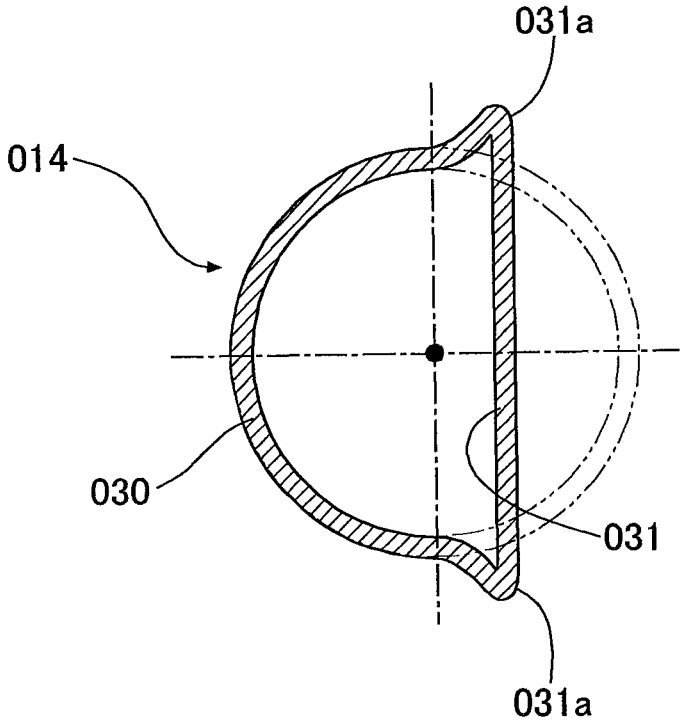
FIG. 9 is a view showing another conventional heat exchange tube and corresponding to FIG. 8.

First, each of the projecting portions 31 is formed into a conical shape which projects to the inside of the tube peripheral wall 30 to be across a tube axis Y, and the vertex portion of the projecting portion 31 forms a substantially semicircular shape. Specifically, a height H of each of the projecting portions 31 is larger than a radius of the tube peripheral wall 30. On forming the projecting portion 31, the periphery of the element pipe of the tube 14 is held with upper and lower two-part molds 33 and 34 as shown in FIG. 6. A punch 36 is slidably inserted in a guide hole 35 which is provided in one mold 33. The punch 36 is in a tapering shape having a substantially semispherical tip end portion, and by pushing the punch 36 into the tube peripheral wall 30 by its radius r or more, the projecting portion 31 projecting across the axis Y is formed inside the tube 14. Specifically, the height of the projecting portion 31 is set to be larger than the radius r of the tube 14.

The tube peripheral wall 30 is divided into a plurality of axial areas A1 and A2, a first area A1 and a second area A2 in the illustrated example. A plurality of the aforementioned projecting portions 31 (three in the illustrated example) are arranged along a first virtual spiral S1 and a second virtual spiral S2 with the turning directions opposite from each other which are drawn in the first and the second axial directions, and in each of the areas A1 and A2, a distance P along the direction of the tube axis Y between the centers of the adjacent projecting portions 31 is set to be smaller than a long diameter D of each of the projecting portions 31.

It should be noted that an upper end portion, an intermediate portion (boundary portion of the areas A1 and A2 in the first and second axial directions) and a lower end portion of the tube 14 keep the circular sectional shapes of the original tube element pipe so as to be closely fitted in the support holes 15*a*, 16*a* and 17*a* of the aforementioned upper support plate 15, intermediate support plate 16 and lower support plate 17.

Next, an operation of this embodiment will be described.

Since in the tube peripheral wall 30, a plurality of projecting portions 31 which project to the inner surface side and formed by pushing are formed into the conical shapes across the tube axis Y, each of the projecting portions 31 is analogous to the shape of a part of the tube peripheral wall 30 being inversed inward, as a result of which, the thickness of each of the projecting portions 31 hardly differs from the thickness of the original peripheral wall 30, or rather decreases. Accordingly, forming of each of the projecting portions 31 by pushing can be easily performed. In addition, the conical projecting portion 31 contributes to effective increase of the surface area of the inside and outside of the tube 14.

Further, a plurality of projecting portions 31 are arranged along the virtual spirals S1 and S2 on the tube peripheral wall 30, whereby, a spiral flow path 32 is formed by a plurality of projecting portions 31 inside the tube 14, and in addition, the sectional area of the flow path 32 changes to be the minimum at the position of the vertex of each of the projecting portions 31 and becomes the maximum at the intermediate position between the adjacent projecting portions 31.

When a high-temperature exhaust gas G passes inside the tube 14 having a plurality of projecting portions 31, the exhaust gas G is effectively agitated by repeating expansion and contraction while turning, whereby every portion of the exhaust gas can be brought into contact with the wide inner surface of the tube 14. Therefore, heat exchange between the exhaust gas G and the water W of the heat receiving chamber 20 can be efficiently performed, and heating of the water W of the heat receiving chamber 20 can be effectively performed.

Furthermore, since by the inward conical projecting portions 31, the outward projections are not formed on the tube peripheral wall 30, the tube 14 is easily inserted through the support holes 15*a* to 17*a* of the aforementioned upper support plate 15 to the lower support plate 17, for example, and the gaps between them can be closed easily and reliably by welding, which can contribute to enhancement in assembling property of the heat exchanger 1.

Further, the aforementioned plurality of projecting portions 31 are arranged along the first and the second virtual spirals S1 and S2 which are drawn in the first and the second axial areas A1 and A2 of the tube peripheral wall 30, and have the turning directions opposite from each other. Therefore, the turning direction of the spiral flow path 32 formed in the tube 14 become opposite in the first and the second axial areas A1 and A2. As a result, the exhaust gas G flowing in the flow path 32 in the tube 14 while turning reverses the turning direction when moving to the second axial area A2 from the first axial area A1. Therefore, agitation of the exhaust gas G can be performed more effectively, and the aforementioned heat exchange can be performed more efficiently.

Further, the distance P along the direction of the tube axis Y between the centers of the adjacent projecting portions 31 in each of the axial areas A1 and A2 is set to be smaller than the long diameter D of each of the projecting portions 31. Therefore, the aforementioned spiral flow path 32 is reliably formed, and the agitation effect of the exhaust gas G can be enhanced.

The present invention is not limited to the above described embodiment, and various design changes can be made within the scope without departing from the gist of the present invention. For example, the number of divisions of the tube 14 when the tube 14 is divided into a plurality of the axial areas A1 and A2, and the number of the projecting portions 31 in each of the axial areas can be properly set in accordance with the demand characteristics of the heat exchanger 1, and the tube 14 can be applied to the heat exchange tubes of the heat exchangers other than those for gas cogenerators.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A heat exchange tube, comprising:

a cylindrical tube peripheral wall, a plurality of projecting portions formed in said cylindrical tube peripheral wall, said plurality of projecting portions projecting towards an inside of said cylindrical tube peripheral wall, wherein said plurality of projecting portions are disposed on said cylindrical tube peripheral wall along a virtual spiral, wherein each of said plurality of projecting portions is formed into a conical shape including a tip which passes through a longitudinal axis of said heat exchange tube, wherein said cylindrical tube peripheral wall is divided into a plurality of axial areas including at least two adjacent axial areas, wherein a turning direction of a portion of said virtual spiral in a first adjacent axial area is reversed relative to a turning direction of a portion of said virtual spiral in a second adjacent axial area, wherein within each of said plurality of axial areas, a distance in a tube axis direction between centers of adjacent projecting portions is smaller than a major diameter of each of the projecting portions, wherein an area of a circular sectional shape is provided between said at least two adjacent axial areas, and wherein said plurality of projecting portions are positioned so as to be offset from each other in the longitudinal tube axis direction, such that at any plane extending perpendicularly to the longitudinal tube axis direction, the center of only one of the tips of the plurality of projecting portions is provided.

* * * * *